US012723848B2

(12) United States Patent
Glenn

(10) Patent No.: US 12,723,848 B2
(45) **Date of Patent: *Sep. 1, 2026**

(54) COMPACT COLLAPSIBLE BALLISTIC BODY ARMOR SYSTEM

(71) Applicant: Tyler Glenn, Westlake Village, CA (US)

(72) Inventor: Tyler Glenn, Westlake Village, CA (US)

( * ) Notice: Subject to any disclaimer, the term of this patent is extended or adjusted under 35 U.S.C. 154(b) by 45 days.

This patent is subject to a terminal disclaimer.

(21) Appl. No.: 18/975,004

(22) Filed: Dec. 10, 2024

(65) Prior Publication Data

US 2026/0153310 A1 Jun. 4, 2026

Related U.S. Application Data

(63) Continuation of application No. 18/797,796, filed on Aug. 8, 2024, now Pat. No. 12,209,847.

(51) Int. Cl.
*F41H 5/08* (2006.01)

(52) U.S. Cl.
CPC ..... *F41H 5/08* (2013.01)

(58) Field of Classification Search
CPC ..... F41H 5/08
See application file for complete search history.

(56) References Cited

U.S. PATENT DOCUMENTS 12,209,847 B1 * 1/2025 Glenn ..... F41H 1/02

* cited by examiner

*Primary Examiner* — J. Woodrow Eldred
(74) *Attorney, Agent, or Firm* — Dunlap Bennett & Ludwig PLLC

(57) ABSTRACT

A collapsible ballistic body armor system having a linear arrangement of two to four armor panels in a deployment condition defining a rectangular prism array of armor panels shielding the front of the user. Each adjacent armor panel is interconnected along their respective edges by a hinge connection so that the collapsible ballistic body armor system is movable between the deployment condition and a folded position. In the deployment condition, a cover panel pivotably attached to each armor panel pivots to cover a gap between each adjacent armor panel. The system provides a neck strap from which initial deployment may be achieved under the urging of gravity.

8 Claims, 11 Drawing Sheets

COMPACT COLLAPSIBLE BALLISTIC BODY ARMOR SYSTEM

CROSS REFERENCE TO RELATED APPLICATION

This application claims the benefit of priority of U.S. non-provisional application number Ser. No. 18/797,796, filed Aug. 8, 2024, as a Continuation thereof, the contents of which are herein incorporated by reference.

BACKGROUND OF THE INVENTION

The present invention relates to ballistic body armor and, more particularly, to a compact collapsible ballistic body armor system.

Protecting the lives of good people from gun violence, which can happen at a moment's notice, is very difficult. Current body armor systems are hard to store, take a long time to put on, and do not offer full protection in the face of indiscriminate shooting.

Specifically, current body armor systems are trying to conform to the odd shape of the human body, and thus when worn it leaves very large gaps or windows of space through which a bullet can pass and directly hit the wearer.

Furthermore, current body systems can take minutes to put on, which is too long when facing the immediate and sudden existential threat of an active shooter.

As can be seen, there is a need for a compact folding ballistic body armor system that provides essentially full body protection.

SUMMARY OF THE INVENTION

A full body armor system embodied by the present invention compacts into a small unit, deployable in seconds and configured to provide more coverage than all current body armor. The full body armor system of the present invention combats active shooting threats in a moment's notice with superior protection. Use cases span from military, law enforcement, private security, and home defense, to wherever else good must try to stop the evil of an active shooter in a moment's notice.

The present invention employs panels that drape from the neck of the user, walling off space between the armor and the wearer. The present invention eschews conforming to the body of the wearer, but rather employs a series of rectangular panels hinged together so that gravity driven deployment, through a hook and loop release system, results in a rectangular prismatic configuration, thereby the ballistic body armor expeditiously shields the entire body in mere moments.

Forming a ballistic shield having rectangular prismatic configuration through draping the series of pivotably-connected rectangular panels under the force of gravity optimizes protection and deployment, while minimizing cost and weight. In contrast, current body armor attempts to fit around, for example, the groin of the wearer, which delays deployment and does not protect any part of the wearer's legs.

The body armor system of the present invention moves between an unfolded position (for deployment) to a folded position (for storage or pre-deployment) in a matter of seconds and provides greater cover area of protection than current body armor systems. Since the present invention comprises hinged rectangular planar panels instead of form-fitting shapes the present invention is also cheaper to mass produce and offers far greater ballistic resistance. The rectangular-based panels can also be made to be much stronger and lighter than form-fitting vest components.

In one aspect of the present invention, a collapsible ballistic body armor system provides a plurality of armor panels, wherein each armor panel is pivotably connected to an adjacent armor panel, at interfacing edges thereof, so that the plurality of armor panels is movable from a folded position to an unfolded position by way of gravity, and wherein the unfolded position is defined by the plurality of armor panels being in a coplanar orientation relative to each other; and one or more cover panels pivotably connected to the plurality of armor panels so that gravity urges each cover panel to cover the adjacent interfacing edges.

In another aspect of the present invention, the collapsible ballistic body armor system further includes the following: two to four armor panels pivotably connected to each other at interfacing edges thereof so that the two to four of armor panels are movable from a folded position to an unfolded position by way of gravity, and wherein the unfolded position is defined by the two to four armor panels being in a coplanar orientation relative to each other; and one or more cover panels pivotably connected to the two to four armor panels so that gravity urges the each cover panel to independently move to a cover position adjacent to each respective interfacing edges; a neck strap configured to hang the plurality of armor panels around a neck of a user to enable gravity to move the two to four armor panels from the folded position to the unfolded position, and wherein the two to four armor panels comprises a face panel and a chest panel, wherein a rear surface of the chest panel provides a trauma pad projecting rearward and configured to urge greater space between the chest panel and a user than afforded by gravity alone in the unfolded position, wherein the face panel has a visor; one or more locking elements projecting from the chest panel so as to support the face panel in an upright position relative to the chest panel, wherein a lower edge of the face panel and an upper edge of the chest panel provide two complementary corner cutouts, respectively, so as to define two opposing voids between the face and chest panels, wherein each void is configured to be adjacent to a shoulder of a user.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a collapsible ballistic body armor system having a linear arrangement of two to four armor panels in a deployment condition, wherein initial deployment may be achieved under the urging of gravity, defining a rectangular prism array of armor panels shielding the front of the user. Each adjacent armor panel is interconnected along their respective edges by a hinge connection so that the collapsible ballistic body armor system is movable between the deployment condition and a folded position. In the deployment condition, a cover panel pivotably attached to each armor panel pivots to cover a gap between each adjacent armor panel.

Figure 1:
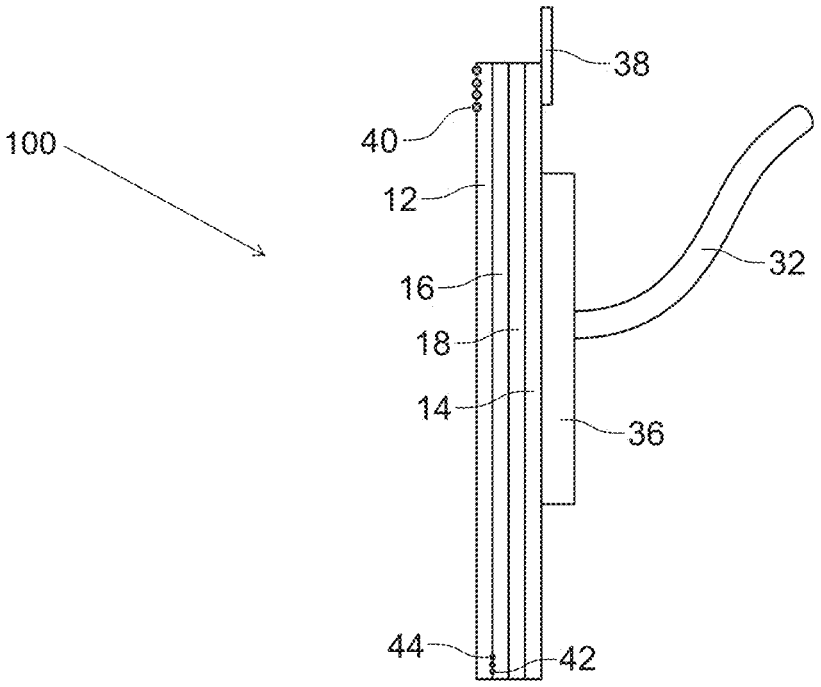
FIG. 1 is a side elevation view of an exemplary embodiment of the present invention, shown in a folded position.
Figure 2:
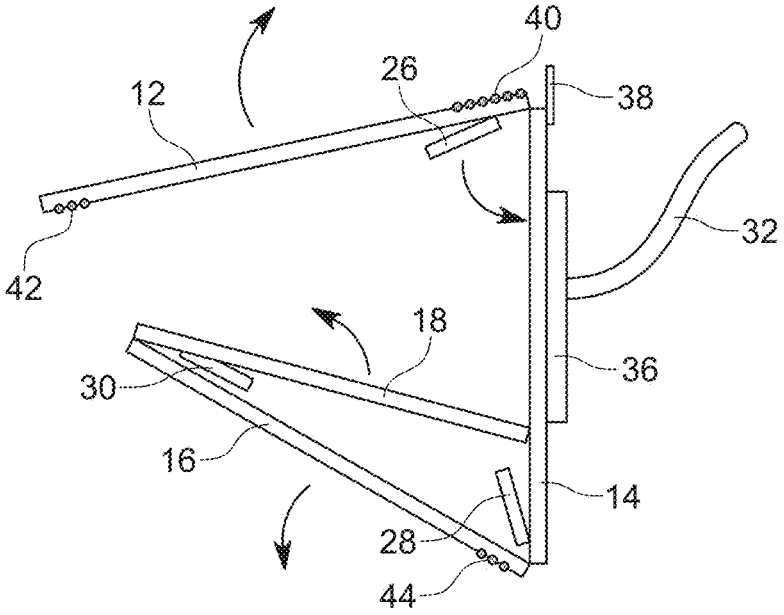
FIG. 2 is a side elevation view of an exemplary embodiment of the present invention, shown unfolding from the folded position to an unfolded position.
Figure 3:
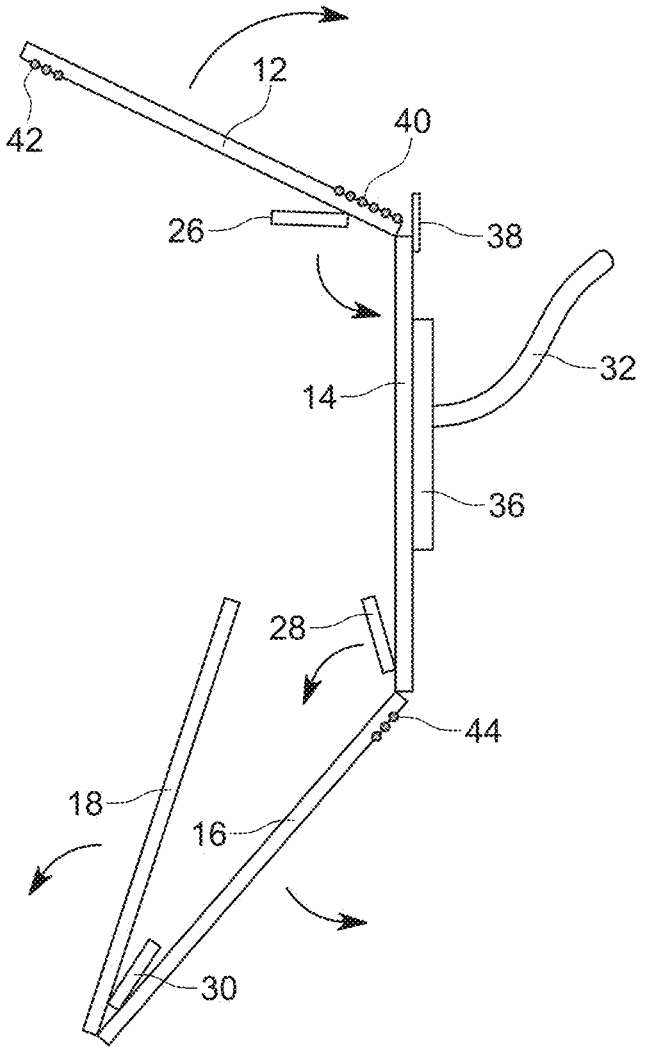
FIG. 3 is a side elevation view of an exemplary embodiment of the present invention, shown unfolding from the folded position to the unfolded position.
Figure 4:
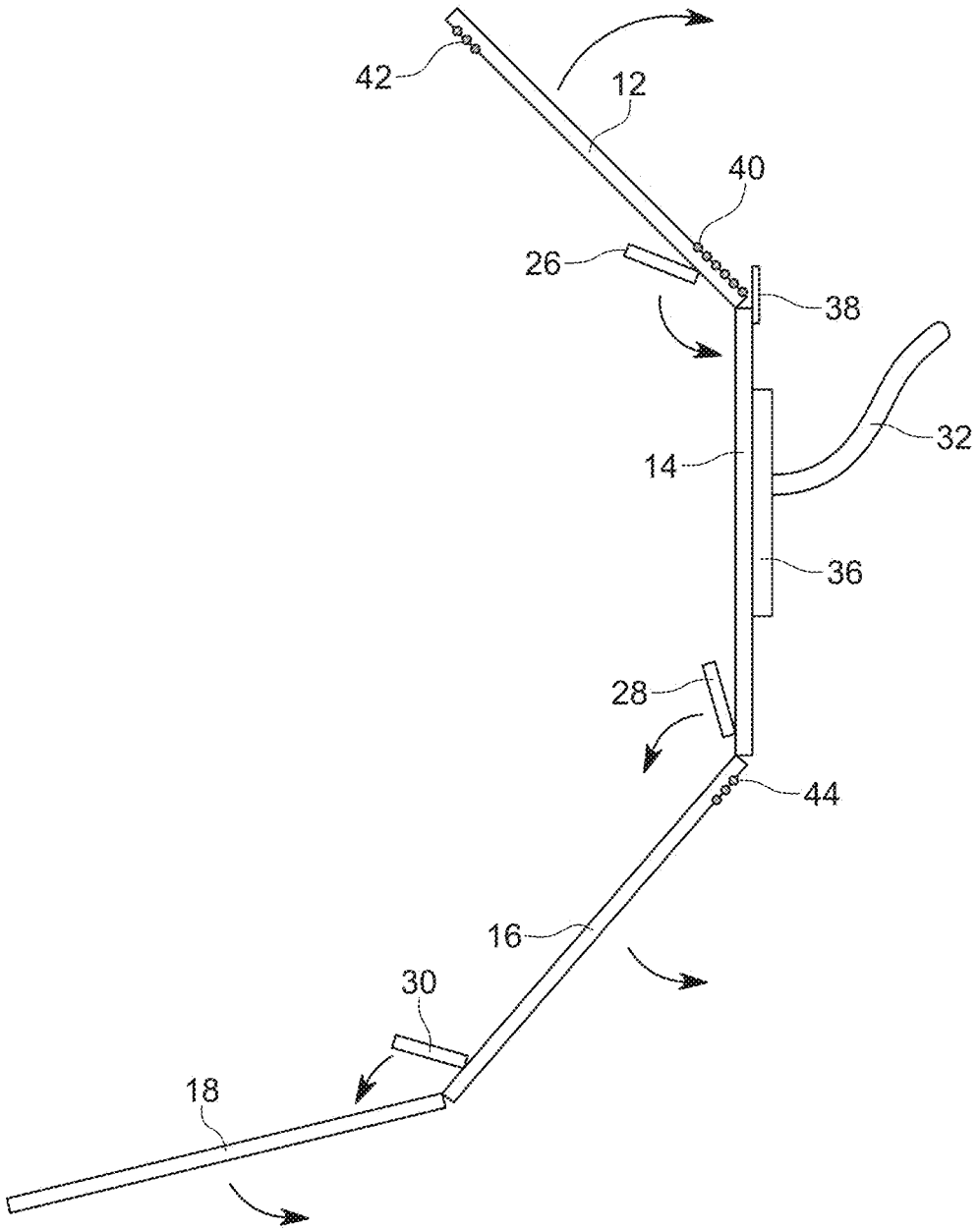
FIG. 4 is a side elevation view of an exemplary embodiment of the present invention, shown unfolding from the folded position to the unfolded position.
Figure 5:
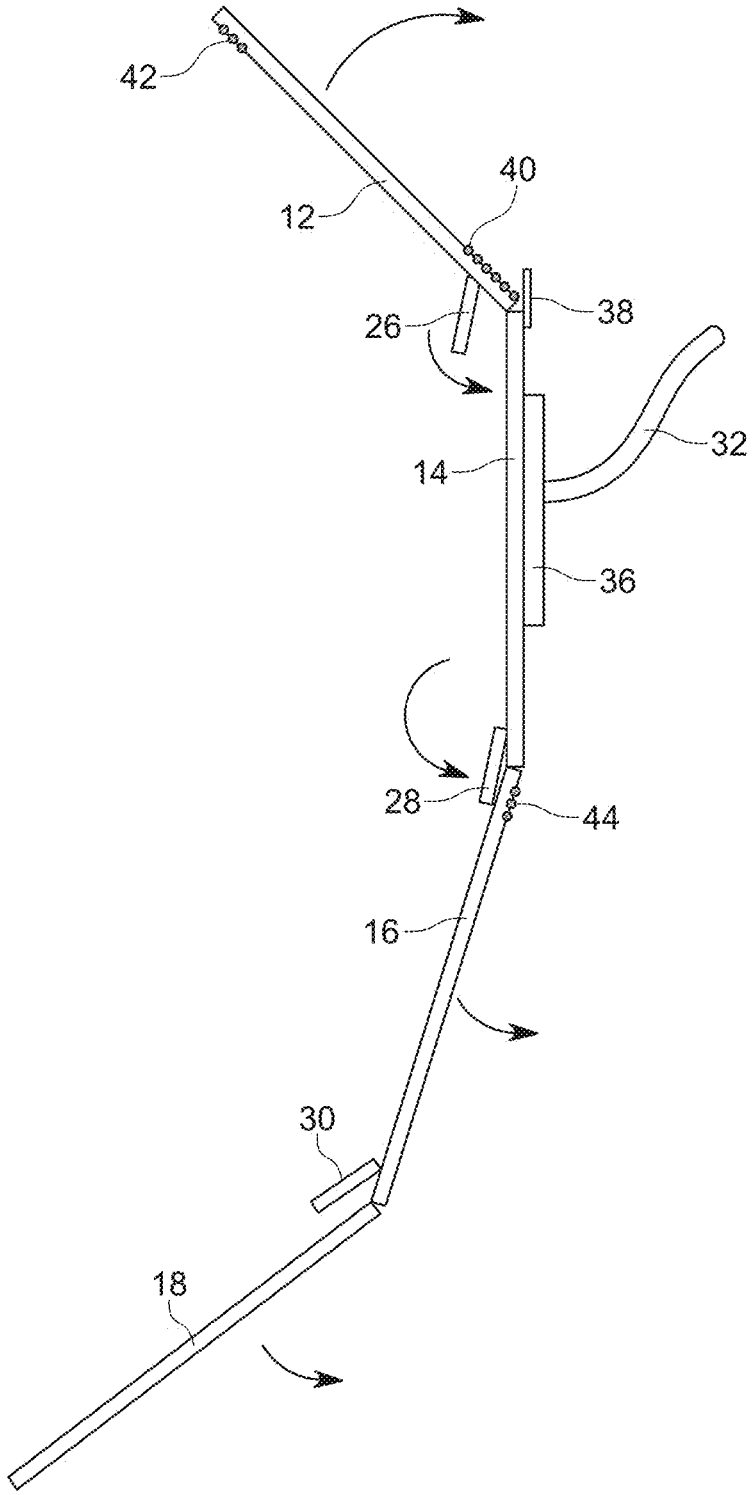
FIG. 5 is a side elevation view of an exemplary embodiment of the present invention, shown unfolding from the folded position to the unfolded position.
Figure 6:
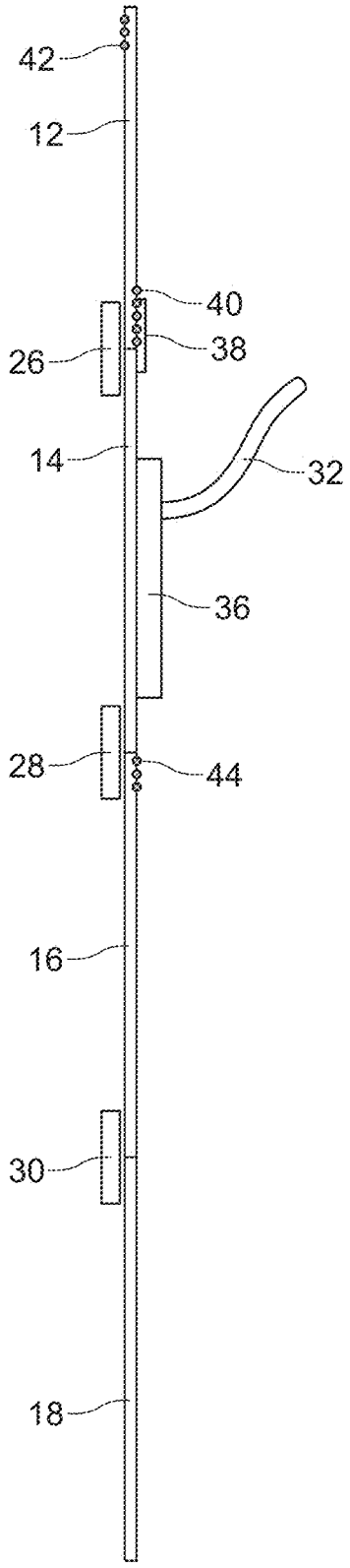
FIG. 6 is a side elevation view of an exemplary embodiment of the present invention, shown in the unfolded position.
Figure 7:
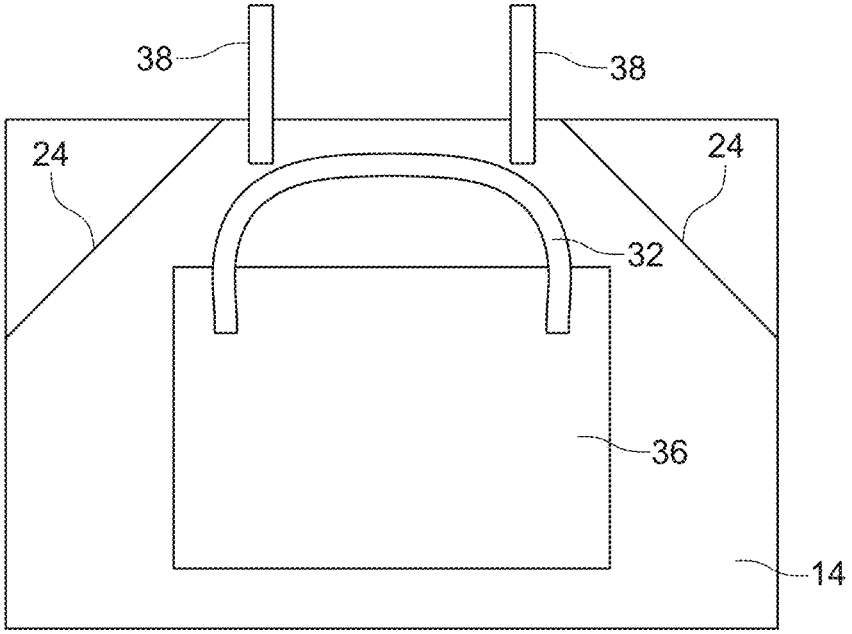
FIG. 7 is a rear elevation view of an exemplary embodiment of the present invention, shown in the folded position.
Figure 8:
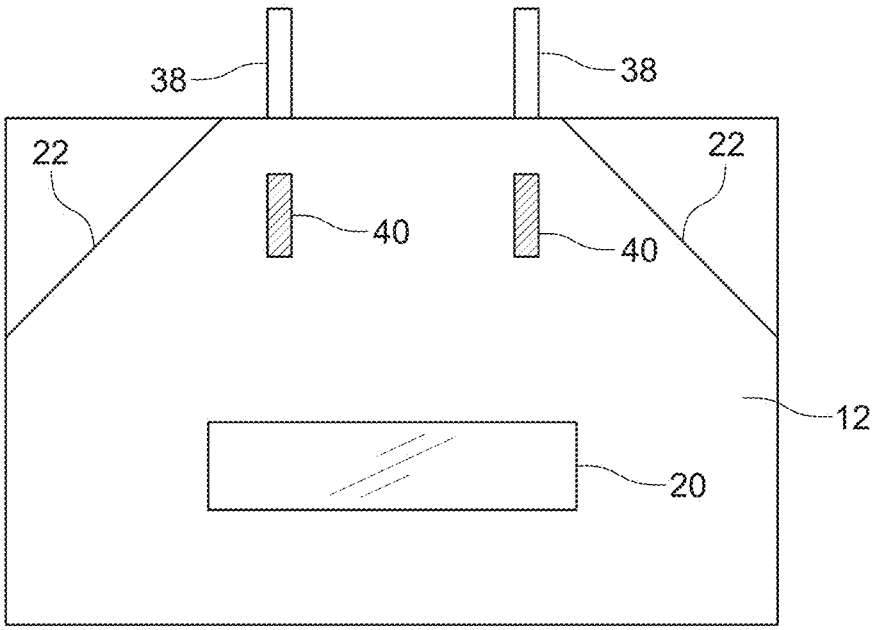
FIG. 8 is a front elevation view of an exemplary embodiment of the present invention, shown in the folded position.
Figure 9:
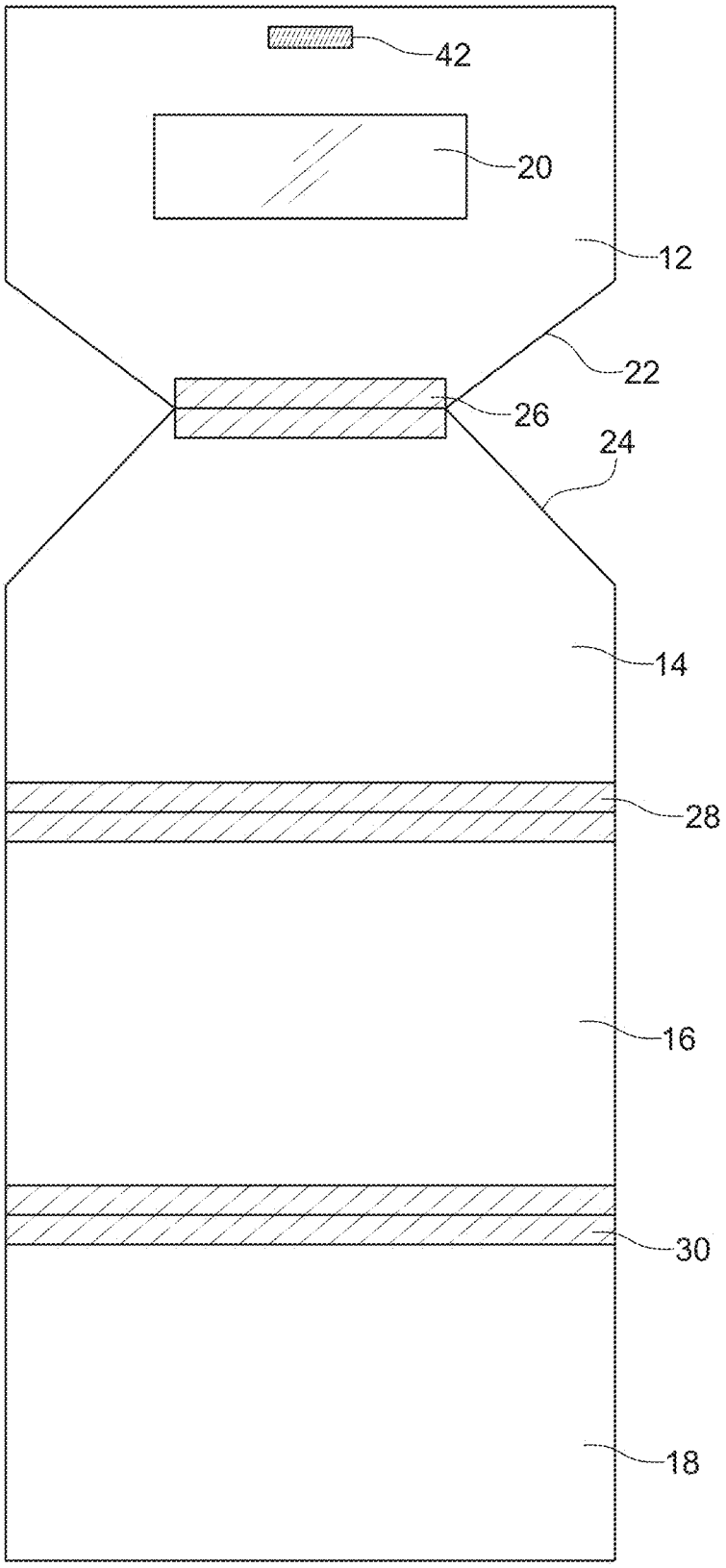
FIG. 9 is a front elevation view of an exemplary embodiment of the present invention, shown in the unfolded position.
Figure 10:
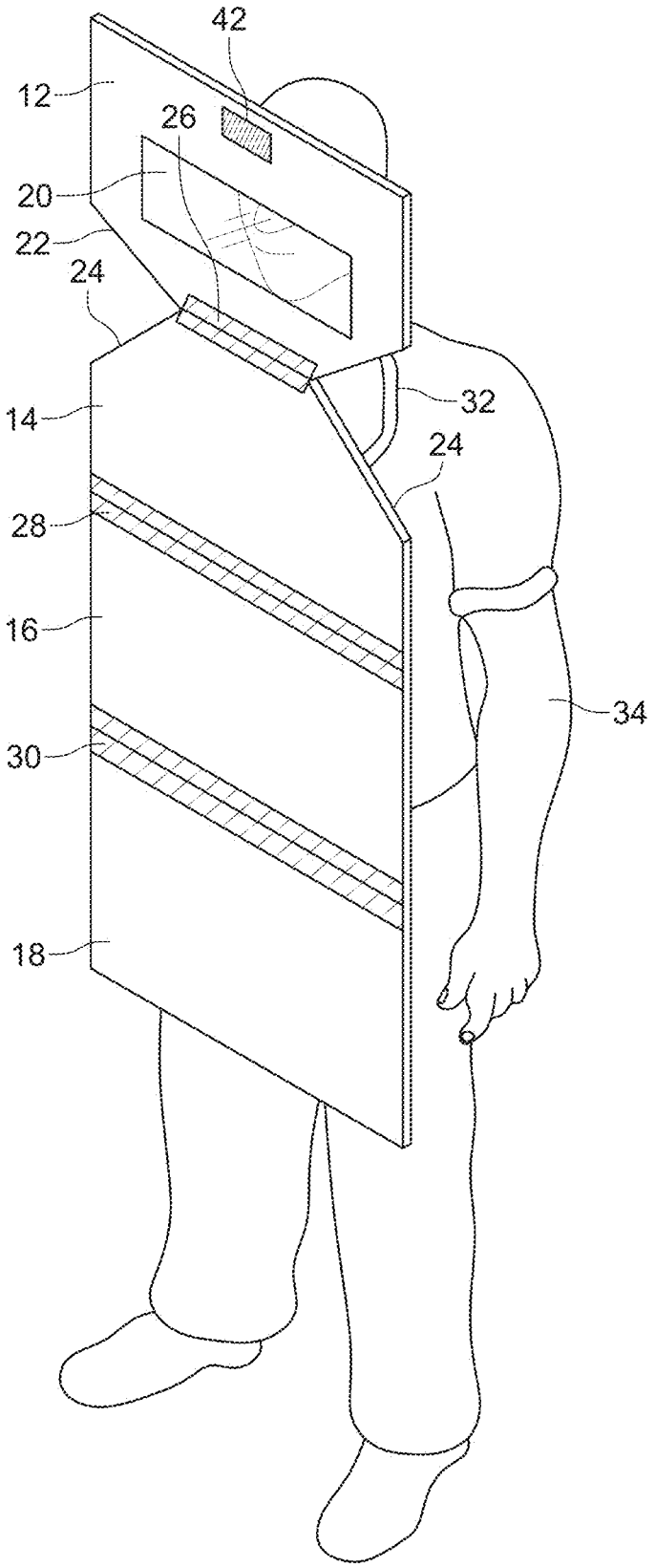
FIG. 10 is a perspective view of an exemplary embodiment of the present invention, shown in the unfolded position in use in a deployment condition.
Figure 11:
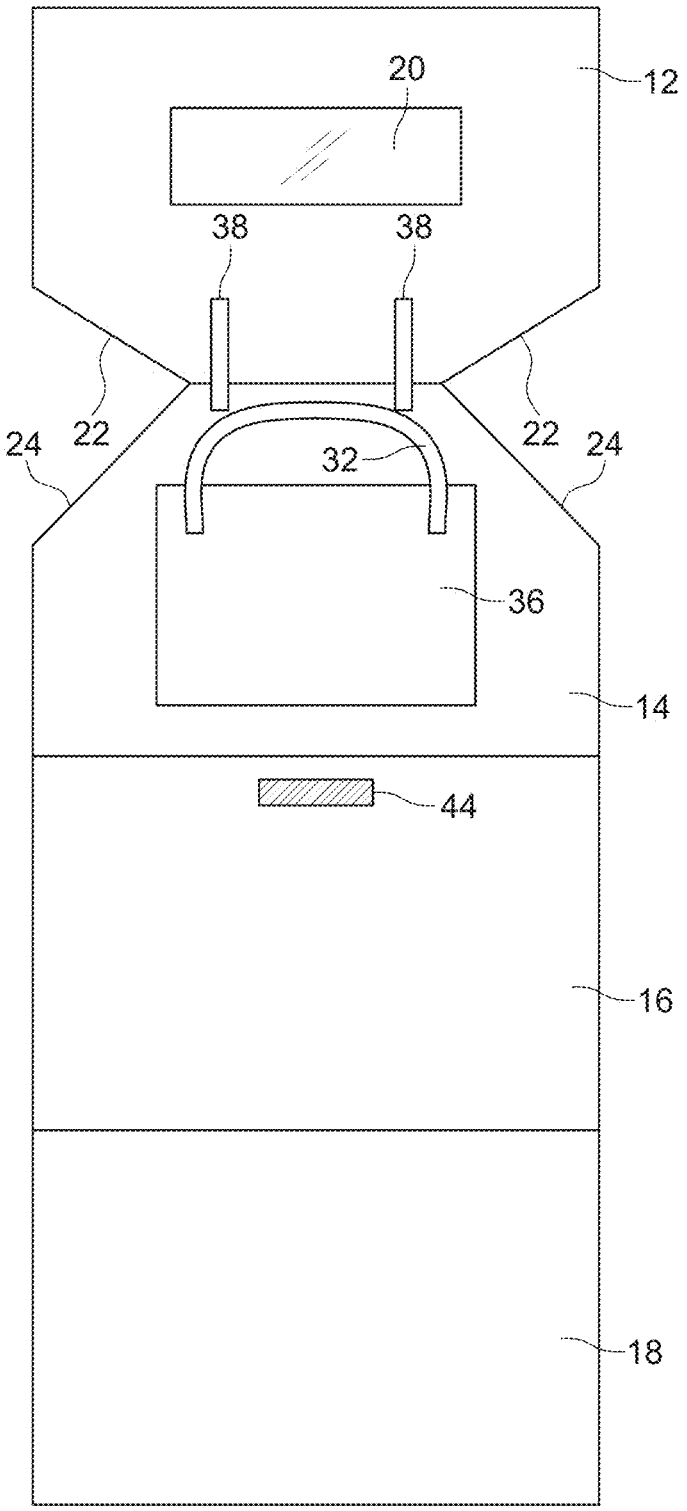
FIG. 11 is a rear elevation view of an exemplary embodiment of the present invention, shown in the unfolded position.
Figure 12:
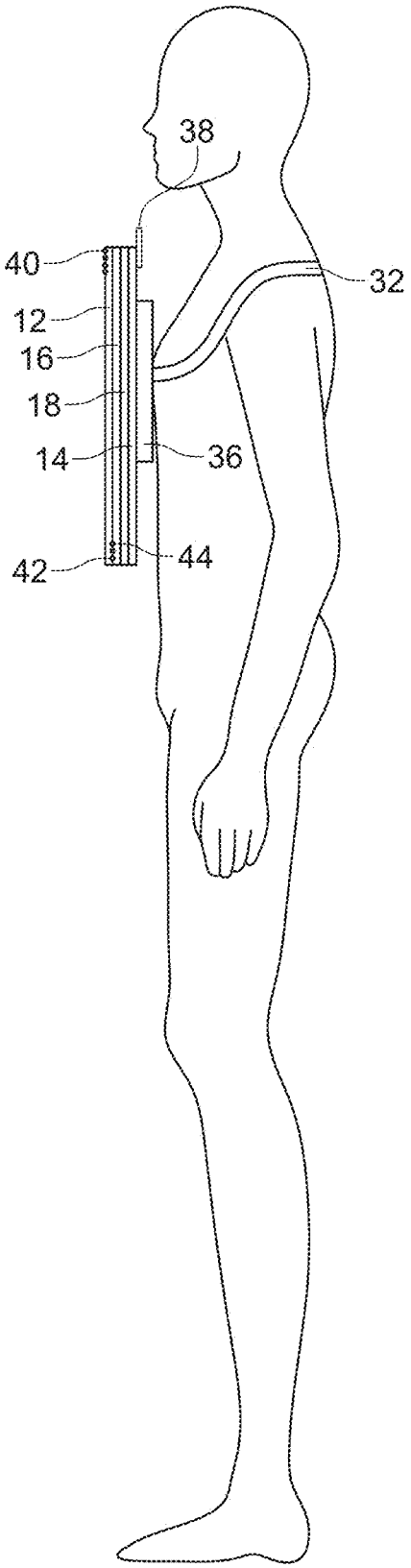
FIG. 12 is a side elevation view of an exemplary embodiment of the present invention, shown in the folded position in use, in a pre-deployment condition.
Figure 13:
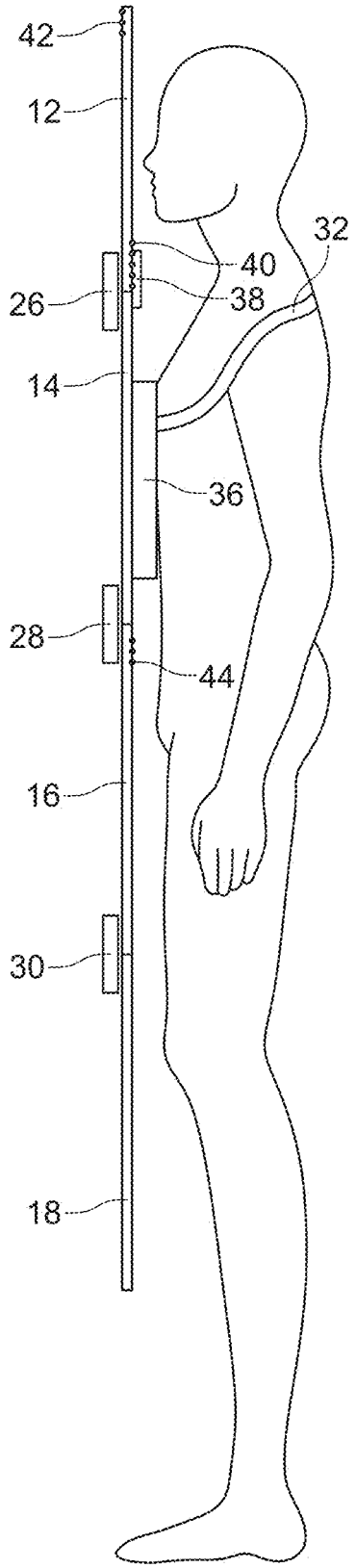
FIG. 13 is a side elevation view of an exemplary embodiment of the present invention, shown in the unfolded position in use, in the deployment condition.

Referring to FIGS. 1 through 13, the present invention is a collapsible ballistic body armor system 100. In the deployment condition, the collapsible ballistic body armor system 100 includes a linear arrangement of plurality of armor panels 12, 14, 16, and 18, wherein each armor panel is hinged to each adjacent armor panel for moving the collapsible ballistic body armor system 100 to the folded position, and then back to the pre-deployment condition.

Directional terms, such as lower, upper, top, bottom, intermediate, upward, downward, and the like refer to the collapsible ballistic body armor system 100 in the unfolded position ready for deployment, as seen in FIGS. 6 and 9-11. Directional terms such as front, forward, rear, rearward, and the like are understood relative to the deployment condition viewable in FIGS. 10 and 12, with the 'front' direction being the direction the user is facing.

A face panel 12 is an uppermost armor panel (in the deployment condition) of the linear arrangement of armor panels. The remainder of armor panels sequentially depend from a lower edge (in the deployment condition) of the face panel 12. The face panel 12 may provide a visor 20, enabling the user to view their environment.

A chest panel 14 depends directly from said lower edge of the face panel 12 by way of an upper edge of the chest panel 14. These respective edges may have lengths less than the latitudinal (upper and lower) edges of the remaining armor panels because of respective cutout corners 22 and 24 of the face panel 12 and the chest panel 14. The cutout corners 22 and 24 facilitate holding a firearm with both hands, because without the cutout corners, the user's arms would have more restricted movement to go up/down and move/aim the weapon. A first cover panel 26 may be dimensioned and shaped to cover a gap, in the unfolded position, between the respective edges of the face and chest panels 12 and 14.

A midbody panel 16 depends directly from a lower edge of the chest panel 14 by way of an upper edge of the midbody panel 16. A second cover panel 28 may be dimensioned and shaped to cover a gap, in the unfolded position, between the respective edges of the chest and midbody panels 14 and 16.

A lower body panel 18 depends directly from a lower edge of the midbody panel 16 by way of an upper edge of the lower body panel 18. A third cover panel 30 may be dimensioned and shaped to cover a gap, in the unfolded position, between the respective edges of the chest and midbody panels 14 and 16.

The first, second, and third cover panels 26, 28, 30 are pivotably joined to a front surface of a respective armor panel so that under the force of gravity as the collapsible ballistic body armor system 100 moves between the folded position and the unfolded condition; wherein the respective cover panel moves from an upward orientation relative to its joined armor panel to a downward orientation in the unfolded position so as to cover the adjacent gap between its armor panel's lower edge and the immediately lower armor panel's upper edge, as illustrated in FIGS. 2 through 6. The pivotable connection may be a living hinge or the like.

Along a rear surface of the chest panel 14, a first locking element 38 connected thereto may project beyond the upper edge of the chest panel 14 so as to releasably connect to a second locking element 40 along the lower portion of the rear surface of the face panel 12. The first and second locking elements 38 and 40 may provide hook and loop fasteners or another locking system capable of holding the face panel 12 in place, by way of the first locking element 38, during the deployment condition. The type of locking element(s) depends on the weight of the armor panels which in turn is a function of the desired ballistic protection level. The first locking element 38 may be a strong bar.

The rear surface of the chest panel 14 may also provide a trauma pad 36 to absorb back face deformation energy and increase panel distance from the user. The collapsible ballistic body armor system 100 may include a neck strap 32 for securing the collapsible ballistic body armor system 100 to a wearer in the unfolded position/deployment condition. Neck strap 36 may stem from the trauma pad 36. The neck strap 32 is dimensioned and shaped to put on like an apron to suspend the collapsible ballistic body armor system 100 from the wearer's chest, during pre-deployment and deployment.

A first connector 42 on the face panel 12 is releasably connectable to a second connector 44 on the rear of panel 16 so that when the collapsible ballistic body armor system 100 is folded into the storage condition the first and second connectors 42 and 44 mate to maintain the folded storage condition, undeployed state. This allows for one single movement of raising the face panel 12 to disconnect it from the other panels and locking into place, by way of the locking elements 38 and 40, fully upright.

The method of deployment for the collapsible ballistic body armor system 100 uses ballistic armor panels (instead of odd-shaped pieces of the prior art that disadvantageously attempts to conform to the human body) that are linearly arranged in an unfolded position, whereby hinges between each adjacent armor panel enables the collapsible ballistic body armor system 100 to fold up or 'collapse' into a parallel arrangement. This allows for an extremely compact system when not deployed, with all armor panels pressed up/sandwiched against each other with no wasted space. When deploying, using a connection of straps or fabric stitching, the panels fold out into place. Most panels fall into place naturally by way of gravity, where the face panel 12 is simply moved upwards and locked into place by the user via the locking elements 38 and 40. A window or visor 20 in the face panel 12, enables the user to see their surrounding environment when using the deployed collapsible ballistic body armor system 100. The present invention may only provide two to four ballistic armor panels that deploy from the chest. A disadvantage of the inventor's previous collapsible ballistic body armor system is the use of magnets to keep the panels secure for projectiles to not slip through the panel connections. The new design embodied in the present invention uses a more reliable cover panel that is configured to fall into place to protect where two panels connect-a form of doubling down on ballistic material in the weak spots to make them the strongest.

To achieve a desired level of protection, the ballistic filler for the panels of the armor system 100 are configured to inhibit the complete penetration of a particular ballistic threat by overcoming the energy associated with the ballistic event. The ballistic filler may include high strength fibers, ceramics, or other material sufficiently resistant to comprise anti-ballistic ply structures.

Each joined edge between adjacent armor panels provides a pivotable attachment, hinge, or the like, thereby enabling each panel to fold relatively to the adjacent panel so that the overall ballistic body armor system 100 is movable between the folded position and an unfolded position. The folded position where all the panels of the ballistic body armor system 100 are arranged in a parallel, non-planar, stacked orientation are maintained by way of the first and second connectors 42 and 44.

In the unfolded position, the armor panel 18 have pivoted about their respective joined edges from the folded position to form the planar, linear arrangement of armor panels. In contrast, current body armor systems that conform to the user's body (form-fitting" systems) are not made of flat shaped panels, and so would never be able to fold up efficiently.

Using flat ballistic panels (can also be non-ballistic like stab proof and impact resistant panels) the system can be folded into the space of a briefcase. This allows for easy storage and quick retrieval from said storage place. Upon retrieving the unit, a wearer starts by putting their head through the neck strap like an apron. When the system is resting on the chest, the wearer lifts the face panel, which is the outermost panel when folded, upwards. While lifting the lower panels fall into place by way of gravity. The next step is to lift the face panel 12 until it locks into place. This is done simply by pressing the panel into the strong support bars/locking elements 38 until the hook and loop fasteners or metal locking system locks the face panel 12 upright. While those movements are being done, all edge cover panels automatically deploy using gravity as well. These cover panels are attached and folded so that the wearer does not have to worry about proper deployment and worry about connecting straps, as the hinged panels will always reliably fall into place if the other actions are done, and the system is folded up properly.

After those movements are completed, a user is now ready to fight with more confidence in your safety against a shooting threat at a moment's notice. This system covers almost all the body while still being lightweight and allowing the user to take in your surrounds through sight and hearing. If the threat is neutralized and other tasks need to be completed, the steps to deploy are done in reverse to fold the system back up. In other words, the ballistic body armor system 100 is folded up in the correct order, and then disconnect face panel from strong bar, and finally lower face panel until it is connected via the first and second connectors 42 and 44 in a parallel, stacked orientation.

Current full body systems take up too much space and time to put on, and do not cover enough of the body. This system exceeds in all three of those aspects while still allowing you to fully engage your target accurately with your firearm. The ballistic threat level protection can go all the way from stab or impact resistance up to NIJ standard level 4. Also, with the added option to have a ballistic window or not, it will be the user's choice. This system fits many different use cases in many fields such as military, law enforcement, private security, and home defense.

An alternative method of the system could be only using two panels. That would be just chest panel 14 and face panel 12, which would be deployed the exact same way. There is also the option to add additional panels or take-away one as the entire system is modular. For example, a six-foot user might need an additional lower panel to fully cover their legs. On the other hand, a smaller user at about five feet, maybe a home-alone teenager that was taught how to defend themselves, would only need three panels as four would be too long. The customization of the number of panels, protection level, and having a ballistic window or not allows the user to feel fully confident and prepared in the exact way they want to be.

The outstanding new features of the present invention are the addition of the strong bar face panel support, the automatic deploying edge cover panels, increased vertical arm movement via the face panel cut, the hook and loop face panel release system and back face deformation padding on the chest panel. The locking elements 38 (which may be strong bars) affords the face panel 12 to be strongly supported without any additional panels being connected for reinforcement. The automatic edge cover panels turn the previous weak spots into double down protection strong points without any additional movement or thought from the user. The additional cut to the face panel for arm movement allows far greater comfortability and accuracy in more kinds of adverse situations. The hook and loop release system allows the deployment motion to be a singular motion by simply lifting the face panel. This allows a much simpler and quicker deployment when faced with an immediate threat.

And finally, the back face deformation padding on the chest allows far less energy to be transferred to the user if stuck by a bullet. Thus, keeping the user not only unharmed but not in as much shock of the realization of being struck. An additional benefit to the back face deformation padding is that it creates more distance between the user and the panels. Additional distance is less energy transfer and allows more room for the body to breathe and not feel so claustrophobic with multiple panels pressed up against most of the body.

Prior existing technology affords 360-degree protection, but this comes at a large cost unfortunately; for example, a 9-panel system has an overall weight the user must bear. Along with the added weight, the older system is much thicker when folded up making it more difficult to store. Only having a 2-4 panel system compared to a 5-9 panel system allows far more comfortability and nearly the exact same confidence of being protected if attached from the front. Such as home defense situation, a user can barricade yourself in the corner of a room ready to engage. For this situation having protection on the sides or rear only impedes the user's ability and offers no additional protection. Moreover, having far less panels in the system will allow the user to maneuver through their environment far greater as well. With panels on the back, they could catch objects or parts of a building, overall creating a distraction and something to worry about in an already chaotic situation.

With the edge cover protection, the user will be able to approach their attacker knowing that they have a complete wall of armor in front of them while being able to engage the attacker as well. This assured confidence that no bullets will slip through the cracks has both amazing physical and mental impacts. Using for example, magnets to attempt to keep the panels in place and stop bullets from slipping through could be a large point of uncertainty and doubt. When one purchases armor to protect yourself in a life-or-death situation, having any form of doubt it will not work is unacceptable. That's why this new system automatically deploys the extra cover panels and is overall a very simple reliable system. Even when shot multiple times, the structural integrity of the whole system will stay together and not just fall apart.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A collapsible ballistic body armor system comprising:

a plurality of armor panels, wherein each armor panel is pivotably connected to an adjacent armor panel at a respective attachment point so that the plurality of armor panels is movable from a folded position to an unfolded position by way of gravity, and wherein the unfolded position is defined by the plurality of armor panels being in a coplanar orientation relative to each other; and one or more cover panels pivotably connected to the plurality of armor panels so that gravity urges each cover panel to cover the respective attachment points.

2. The collapsible ballistic body armor system of claim 1, further comprising a neck strap configured to hang the plurality of armor panels around the neck of a user.

3. The collapsible ballistic body armor system of claim 1, wherein the plurality of armor panels comprises two to four armor panels.

4. The collapsible ballistic body armor system of claim 1, wherein the plurality of armor panels comprises a face panel and a chest panel.

5. The collapsible ballistic body armor system of claim 4, wherein a rear surface of the chest panel provides a trauma pad projecting rearward and configured to urge greater space between the plurality of armor panels and a user than afforded by gravity alone.

6. The collapsible ballistic body armor system of claim 4, wherein the face panel has a visor.

7. The collapsible ballistic body armor system of claim 4, further comprising one or more locking elements projecting from the chest panel so as to support the face panel in an upright position relative to the chest panel.

8. The collapsible ballistic body armor system of claim 4, wherein a lower edge of the face panel and an upper edge of the chest panel provide two complementary corner cutouts, respectively, so as to define two opposing voids between the face and chest panels, wherein each void is configured to be adjacent to a shoulder of a user.

* * * * *